United States Patent [19]

Morgan et al.

[11] Patent Number: 4,787,178

[45] Date of Patent: Nov. 29, 1988

[54] FLUID-JET CUTTING APPARATUS

[75] Inventors: G. Michael Morgan, Fairfield; W. Douglas Hipp, Jefferson County, both of Iowa; Henry R. Sterner, San Diego, Calif.; L. Bruce Moore, Rock Island, Ill.

[73] Assignee: Creative Glassworks International, Inc., Fairfield, Iowa

[21] Appl. No.: 37,380

[22] Filed: Apr. 13, 1987

[51] Int. Cl.[4] ..... B24C 3/32

[52] U.S. Cl. ..... 51/418; 51/319; 51/215 CP; 51/215 E; 83/53; 83/98; 83/177; 198/434; 198/468.2; 198/721

[58] Field of Search ..... 51/417, 418, 319–321, 51/283, 215 E, 215 CP; 83/53, 177, 98; 198/434, 468.2, 468.1, 721, 740; 414/225, 226; 901/7

[56] References Cited

U.S. PATENT DOCUMENTS

| | | | |
|---|---|---|---|
| 2,195,810 | 4/1940 | Bower | 51/417 |
| 3,076,366 | 2/1963 | Grandstedt | 83/98 |
| 3,226,527 | 12/1965 | Harding | 83/177 |
| 3,283,918 | 11/1966 | Devol | 901/7 |
| 3,469,887 | 9/1969 | Nakahara | 83/98 |
| 3,877,334 | 4/1975 | Gerber | 83/22 |
| 3,978,748 | 9/1976 | Leslie et al. | 83/53 |
| 4,006,656 | 2/1977 | Shinomiya | 83/11 |
| 4,058,040 | 11/1977 | Fisher | 83/177 |
| 4,092,889 | 6/1978 | Fisher | 83/177 |
| 4,116,097 | 9/1978 | Graham et al. | 83/155 |
| 4,137,804 | 2/1979 | Gerber et al. | 83/177 |
| 4,312,254 | 1/1982 | Pearl | 83/177 |
| 4,501,182 | 2/1985 | Jardat et al. | 83/177 |
| 4,573,382 | 3/1986 | Kloehn et al. | 83/53 |
| 4,702,042 | 10/1987 | Herrington et al. | 51/326 |

FOREIGN PATENT DOCUMENTS

| | | | |
|---|---|---|---|
| 1287585 | 8/1972 | United Kingdom | 83/177 |

*Primary Examiner*—Robert P. Olszewski

*Attorney, Agent, or Firm*—Bell, Seltzer, Park & Gibson

[57] ABSTRACT

A sheet of glass or similar material is moved to and in the cutting area of the apparatus by sheet gripping assemblies that engage and grip an edge portion of the sheet, and that undergo precise controlled movement. A fluid-jet discharging nozzle moves above the sheet along a path of travel normal to the sheet movement. Belts supportively underlying the sheet are driven sufficiently in unison therewith to minimize possible scratching or other marring of the glass. To the same end, the lower portion of the fluid-jet nozzle is of tapered shape. Sheet-engaging clamps of the gripping assemblies are moveable in a manner adapted to prevent damage to the glass sheets engaged thereby. Positioning structure may be provided for receiving and positioning the glass sheets preparatory to the cutting thereof.

33 Claims, 8 Drawing Sheets

FLUID-JET CUTTING APPARATUS

This invention relates to cutting apparatuses that employ concentrated high-velocity jets of fluid, such as water, as the cutting means. The invention more specifically relates to a fluid-jet cutting apparatus that is particularly, but not necessarily exclusively, adapted for cutting intricate designs and shapes in and/or from sheets of glass with a high degree of precision and efficiency, while minimizing the possibility of the glass incurring damage during the cutting operation.

BACKGROUND OF THE INVENTION

Water-jet cutting apparatuses are well known in the art and have long been used in industry for cutting sheet materials of various types. Illustrative apparatuses are disclosed in British Pat. No. 1287585 and the following U.S. Pat. Nos. 3,877,334, 3,978,748, 4,006,656, 4,092,889, 4,116,097, 4,137,804, 4,312,254 and 4,501,182. The apparatuses typically include support means for supporting the sheet material to be cut, nozzle means for directing the high-velocity fluid jet against the material upon the support means, drive means for producing controlled relative movement between the nozzle and the supported material along two orthogonal axes, and energy dissipating means for receiving the fluid jet and dissipating the energy thereof following its penetration through the material being cut. The apparatus may further include, particularly when the material being cut consists of flexible fabric or the like, means for compressing the material against the support so as to prevent undesirable "flutter" or similar movement of it during the cutting operation. It is also known to provide fluid-jet cutting apparatuses with devices for facilitating the introduction therein of the material to be cut.

In most of the known fluid-jet cutting apparatuses, and particularly those that must perform relatively intricate cutting operations with a high degree of precision, the nozzle means is mounted for controlled bi-directional movement along two orthogonal axes, and the sheet material to be cut remains stationary during the cutting operation. Since in an apparatus of this type the nozzle moves over a large part of the underlying support means, the containment of and dissipation of energy from the fluid jet, following its passage through the material being cut, presents something of a problem. One previously proposed solution is to provide substantially the entire area of the support means with jet receiving and energy-dissipating means: see, e.g., U.S. Pat. No. 4,312,254. Another previously proposed solution utilizes a slotted support means and an underlying fluid-jet receiver that are aligned with each other and with the overlying nozzle means and that are moveable in unison therewith along at least one of the two orthogonal axes of movement of the nozzle: see, e.g., U.S. Pat. Nos. 4,137,804, 4,092,889 and 3,978,748. A disadvantage of apparatuses of either of the foregoing "stationary work" types is that the cost of maintenance and periodic replacement of the fluid jet receiving and energy dissipating components thereof is relatively great in comparison to the cost of maintaining and replacing components that are smaller and stationary. The difference in expense becomes particularly significant in the case of fluid-jet cutting apparatuses that are adapted to cut glass or other hard material, and which usually have particulate grit such as garnet entrained within the cutting fluid, since in this instance the components require much more frequent maintenance and/or replacement.

A stationary and relatively small fluid-jet receiving and energy-dissipating means may be employed in a fluid-jet cutting apparatus wherein the nozzle undergoes movement along only one of the two orthogonal axes, and the sheet material to be cut is moved by underlying support means along the other of the axes. U.S. Pat. No. 4,501,182 discloses an apparatus of this type in which the support means consists of a single driven belt or apron that supports material to be cut and that has longitudinally spaced flights on opposite sides of a slotted bridge that underlies the fluid discharging nozzle and that overlies the fluid receiving and energy-dissipating components of the apparatus. A somewhat similar apparatus having two separate article-supporting belts or aprons on opposite sides of an intervening slot is disclosed in British Pat. No. 1287585 and is discussed in the prior art description of U.S. Pat. No. 4,092,889. The latter patent points out that apparatuses of the foregoing type have significant disadvantages. They customarily are unable to achieve a high degree of precision in their cutting operations due to the difficulty or impossibility of driving the two work supporting belts at precisely the same speed and through identical displacements. As is noted in the patent, when the material or article to be cut is rigid and is supported and moved by two separate belts, its speed may vary at different times during the cutting operation depending upon which belt provides the dominant support. An additional difficulty is presented when the article or material supported and moved by the belt is not only rigid, but also smooth-surfaced. In this situation slippage may occur between the belts and the supported article or work, as well as between the belts and their drive components, with ensuing impairment of the precision of the cutting operation.

The aforesaid "slippage" disadvantage may be at least partially overcome with some rigid materials by the provision in the apparatus of additional moveable rolls and/or belts that overlie the sheet material to be cut and that force it downwardly into firmer engagement with the underlying supporting belt. However, this approach cannot be safely employed when material to be cut is sheet glass or similar material which is not only smooth and hard, but which is also highly susceptible to breakage and/or to becoming scratched and therefore rendered unsuitable for many intended utilizations. The problem of scratching of the glass is aggravated by the fact that particulate garnet or similar grit frequently must be and is contained within the cutting fluid used in the cutting operation. During at least the initial stages of each cutting operation, some of the grit entrained within cutting fluid will be deposited outside of the cutting area upon the upper surface of the glass. If the deposited grit is forced downwardly against the glass surface by an overlying roller or belt, particularly one that may not be driven at precisely the same speed as the glass sheet, scratching or other marring of the glass can easily ensue.

With the foregoing in mind, the primary object of the present invention is the provision of a fluid-jet cutting apparatus that is particularly, but not necessarily exclusively, adapted for efficiently and precisely cutting sheets of glass or similar material without breaking or otherwise damaging the material.

SUMMARY OF THE INVENTION

The present invention provides a fluid-jet cutting apparatus that realizes the aforesaid object and that includes a fluid-jet discharging nozzle that is mounted for precise controlled bi-directional movement parallel to a first one of two orthogonal axes, support means for supporting a sheet of glass or similar material preparatory to and during cutting, and sheet moving means for imparting precise controlled bi-directional movement to the sheet along the second one of the aforesaid orthogonal axes. In a preferred illustrative embodiment of the invention the support means of the apparatus includes two endless belts that underlie the glass sheet and that also undergo movement parallel to the aforesaid second axis. However, the movement imparted to the sheet by the sheet moving means is independent of the belt movement, and is not affected by possible variations in the speeds of the supporting belts relative to each other and/or to the glass sheet. While movement of the sheet-moving means of the apparatus may and illustratively does also effect approximately synchronous movement of the sheet supporting belts, this is primarily for the purpose of minimizing possible scratching of or other damage to the glass sheet. Preservation of the desirable appearance of the glass and avoidance of inadvertent breakage thereof is further assisted by the fact that the apparatus does not require any overlying rolls, aprons or other components for engaging and exerting unbalanced vertical forces upon the glass. Additionally, the fluid-discharging nozzle of the apparatus may be and preferably is so shaped as to minimize possible marring of the upper surface of the glass by reflection from the nozzle of particles of the grit contained within the fluid.

In a preferred embodiment the sheet-moving means includes a plurality of clamping members that engage an edge portion of the glass sheet.

The apparatus may and illustratively does further include means for receiving and properly positioning a glass sheet preparatory to its being transported to the sheet supporting means.

DESCRIPTION OF THE DRAWINGS

Other features of the invention will be apparent from the following description of an illustrative embodiment thereof, which should be read in conjunction with the accompanying drawings, in which.

DESCRIPTION OF THE PREFERRED EMBODIMENT

Figures 1, 2, 3:
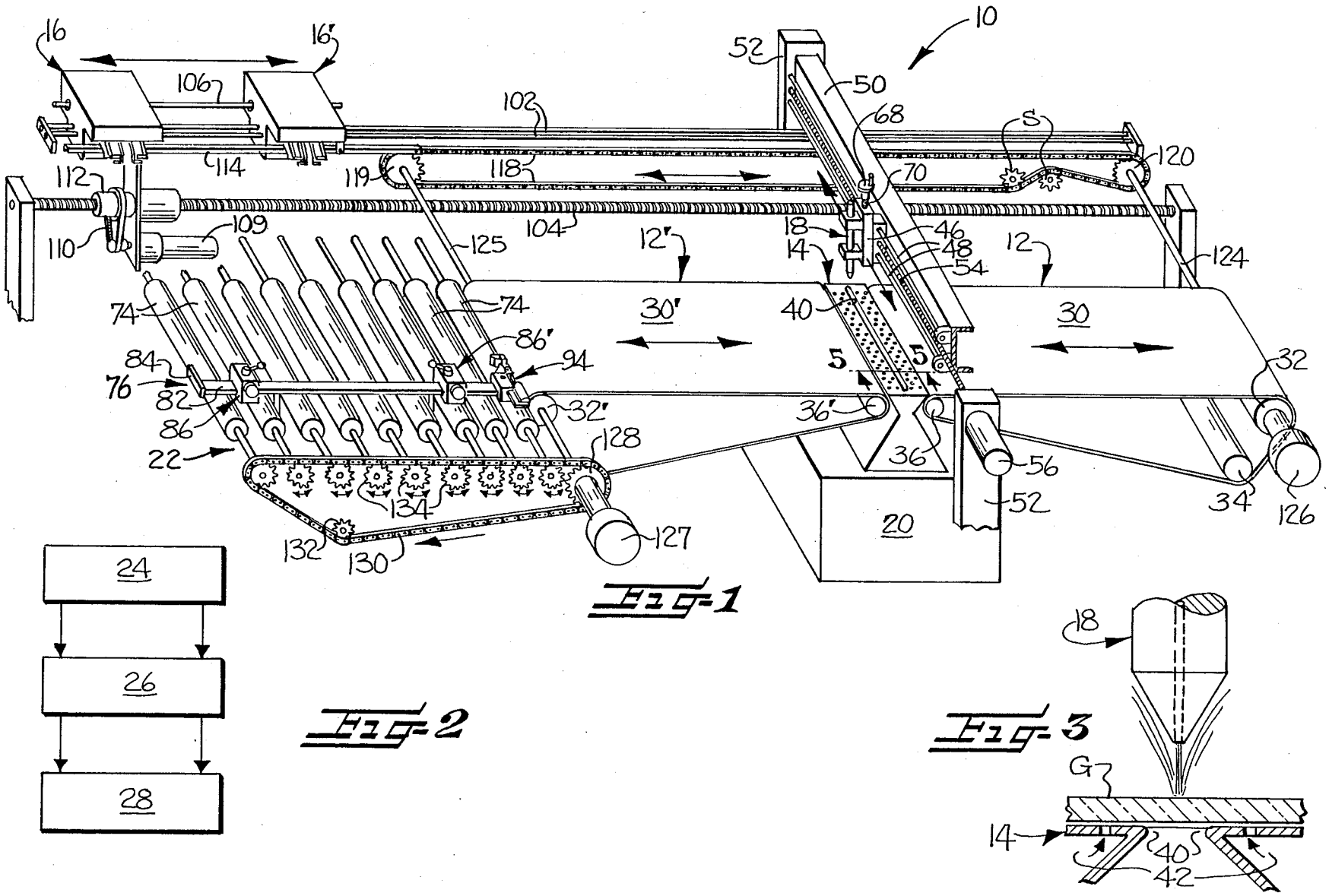
FIG. 1 is a fragmentary and partially schematic right side perspective view of a fluid-jet cutting apparatus in accordance with the invention.
FIG. 2 is a diagramatic representation of computer-type control means of the apparatus, and of components for directing control data thereto and for receiving control signals therefrom.
FIG. 3 is an enlarged fragmentary elevational view of the outlet end portion of the fluid-discharging nozzle of the apparatus, there also being shown in vertical section a part of the underlying support means and a glass sheet thereon.

The fluid-jet cutting apparatus 10 shown in the drawings is particularly adapted for cutting intricate or other shapes from or in sheets G of glass or other material that is susceptible to breakage, scratching or similar damage. The following major components of apparatus 10 are shown, in partially schematic form, in FIG. 1: sheet supporting means which includes a pair of longitudinally extending and spaced endless belt assemblies 12, 12', and an intervening bridge structure 14; sheet moving means, that includes a pair of moveable sheet gripping assemblies 16, 16', for moving a glass sheet longitudinally of the apparatus and parallel to its central axis; nozzle means 18, that is moveable along an axis orthogonal to the aforesaid central axis of the machine, for discharging a high velocity jet of fluid and therein entrained particulate material against that portion of the glass sheet overlying bridge structure 14; fluid jet receiving means, in the form of a tank-like member 20 that underlies bridge structure 14; and an optional sheet receiving and positioning means 22 for receiving and positioning a glass sheet for subsequent movement at an appropriate time toward the cutting area of the apparatus. In addition to the foregoing components, the apparatus further includes mounting means mounting the moveable apparatus components for movement along their intended paths of travel; drive means for imparting movement to the components along such paths; and various other controllable mechanisms such as valves, actuators and clutches. These controllable components of apparatus 10 are collectively designated in the diagram of FIG. 2 of the drawings by the block 24. As indicated by the arrows in FIG. 2, the controllable components 24 are controlled by and receive control inputs from a computer or similar controller 26, which in turn receives input data from various sources 28 which typically include a computer program, a manually actuated keyboard, encoders or other means for monitoring the positions and/or conditions of various of the moveable components of the apparatus, safety or limit switches, etc. Among other important functions, controller 26 so coordinates the perpendicular relative movements of nozzle means 18 and a glass sheet G being cut as to allow cuts of highly intricate shape to be made in and/or from a sheet with extremely high precision.

Figure 4:
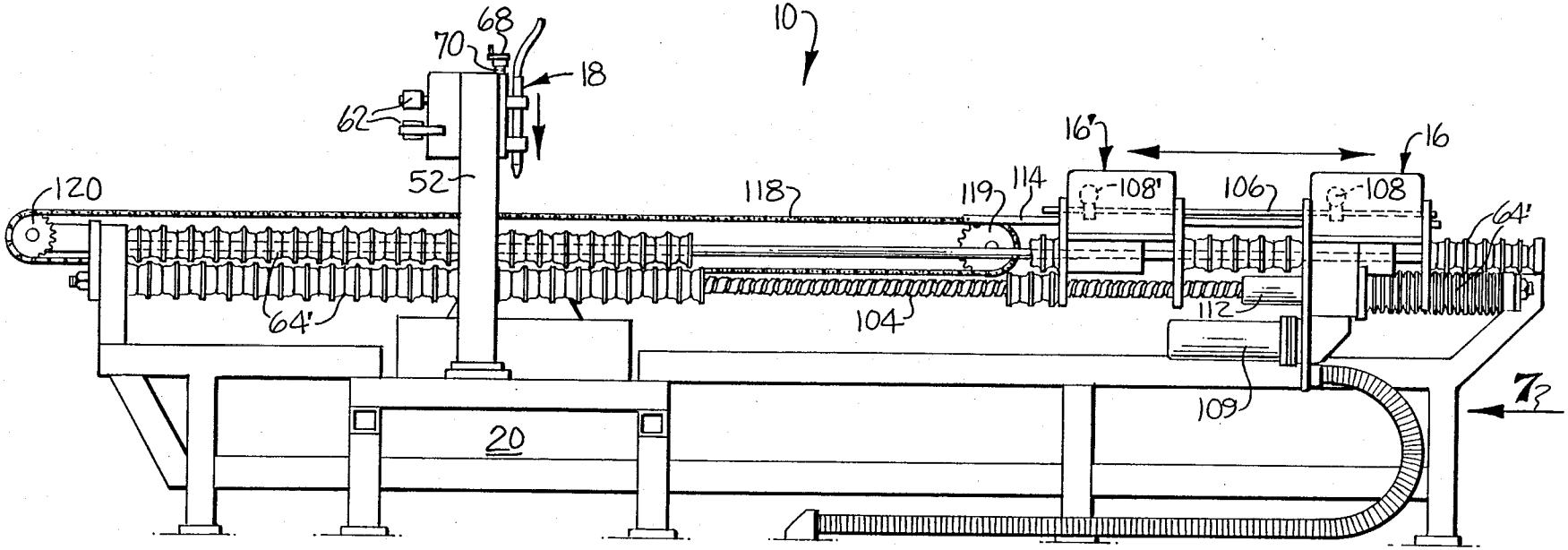
FIG. 4 is a left side elevational view of the apparatus.
Figure 5:
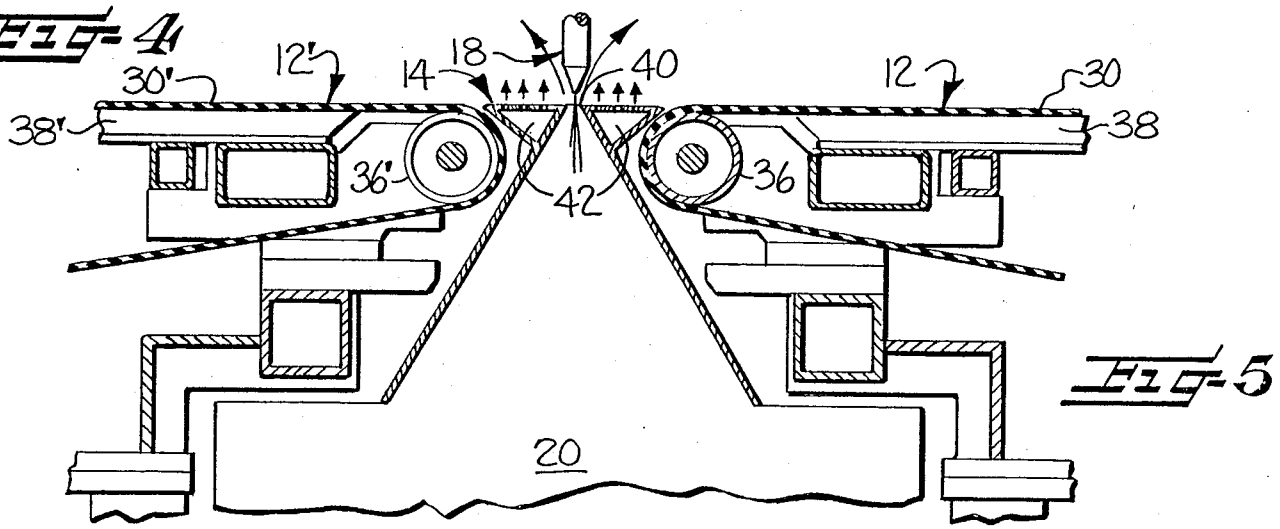
FIG. 5 is a fragmentary longitudinal section taken substantially along the line 5—5 of FIG. 1 and showing adjacent end portions of the two sheet supporting belt assemblies of the apparatus, together with some intervening components.
Figure 6:
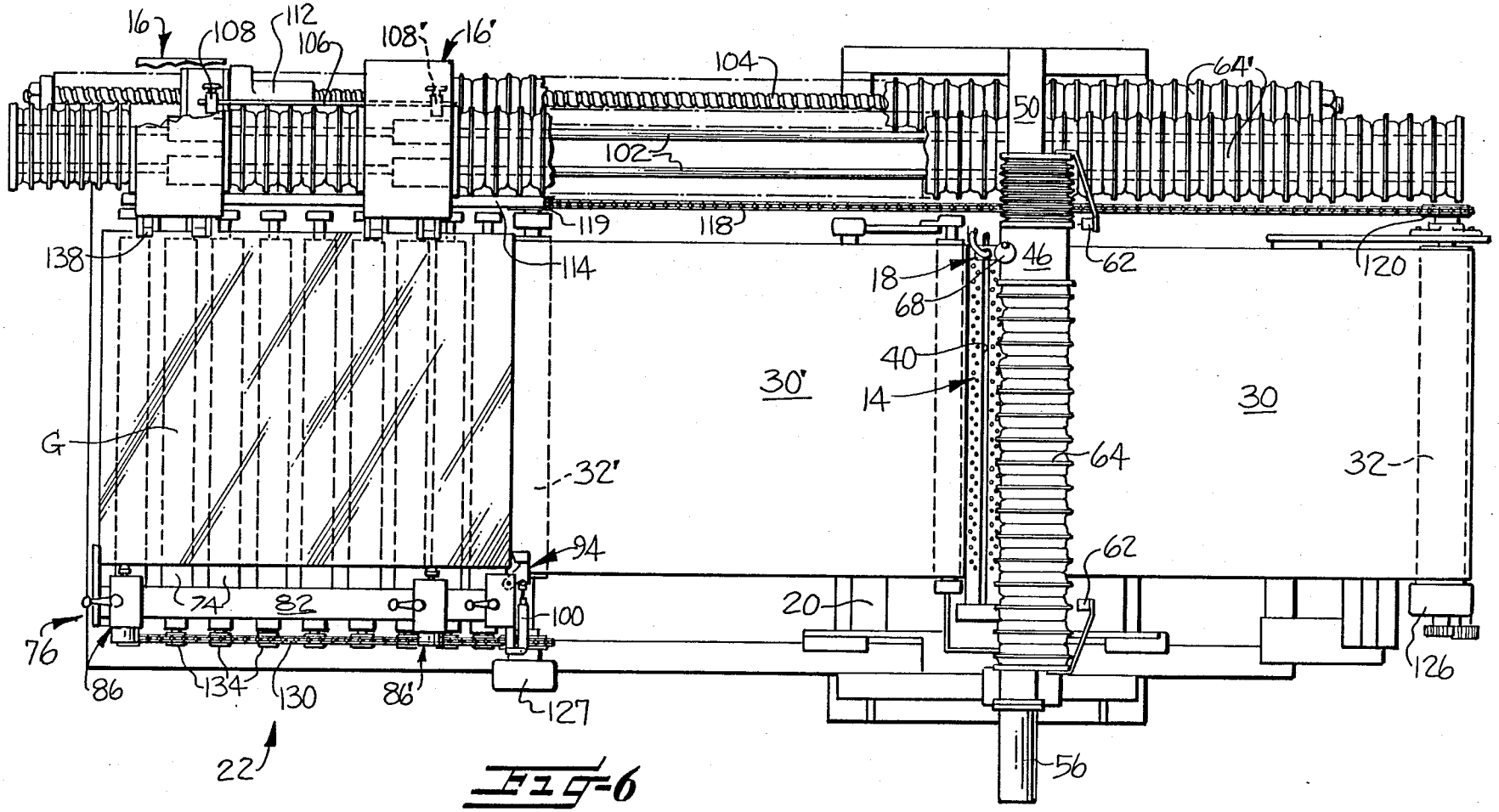
FIG. 6 is a top plan view of the apparatus.
Figure 7:
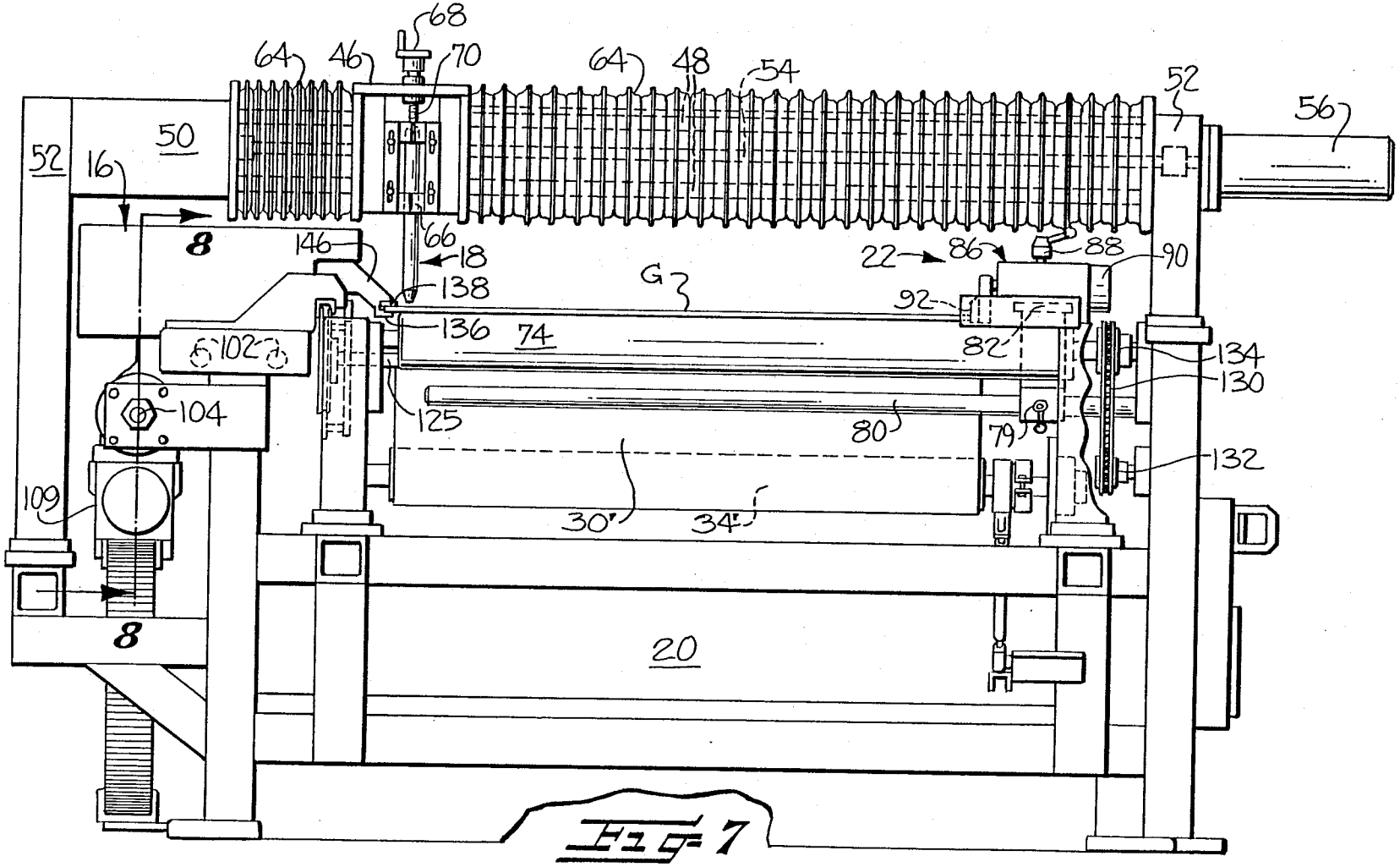
FIG. 7 is an end elevational view of the apparatus, looking in the direction of the arrow 7 of FIG. 4.
Figure 8:
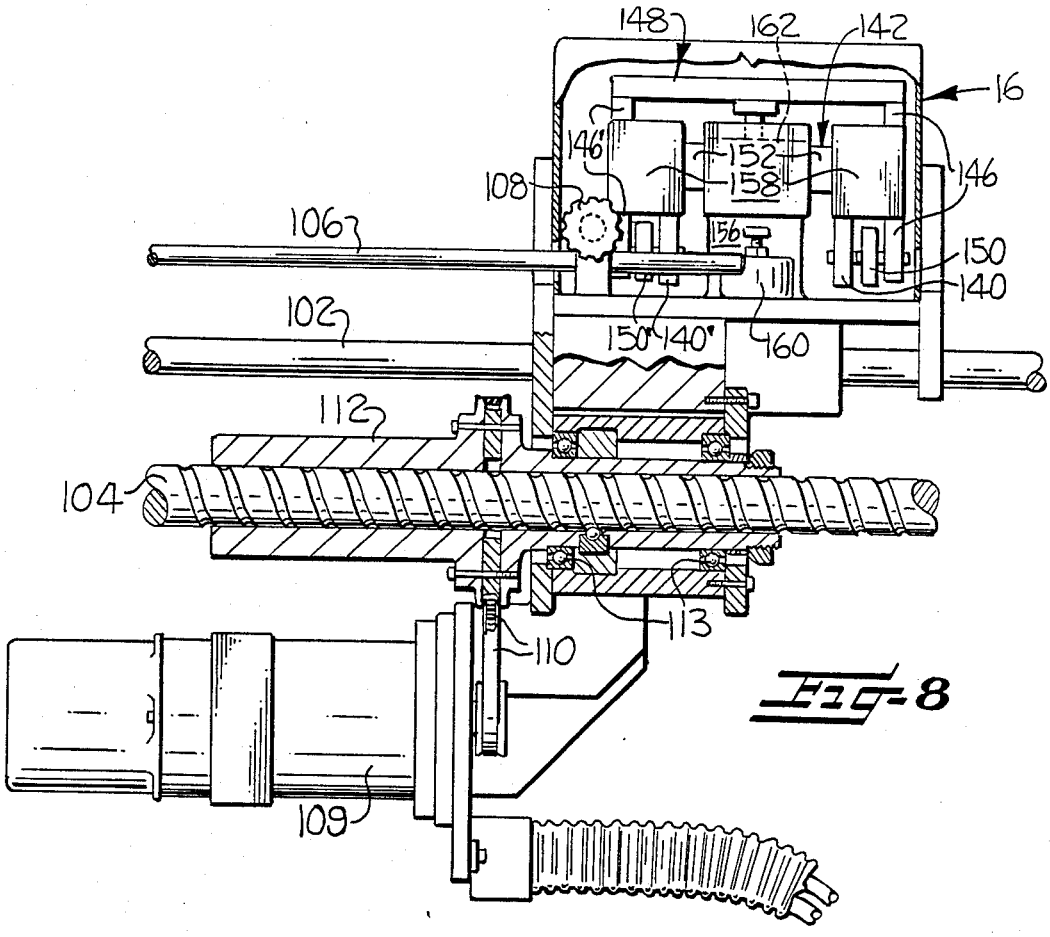
FIG. 8 is an enlarged fragmentary view, partially in elevation and partially in vertical section taken approximately along the line 8—8 of FIG. 7, of one of the sheet-moving assemblies of the apparatus, together with related mounting and drive components.

Referring now also to FIGS. 4–6 of the drawings, as well as to FIG. 1, the assembly 12 of the sheet supporting means of the apparatus includes an endless apron or belt entrained about a drive roll 32, a tensioning roll 34, and a third roll 36 disposed closely adjacent bridge structure 14 of the sheet supporting means. The horizontally extending upper flight of assembly 12 closely overlies and is bi-directionally moveable relative to a rigid support platform 38 (FIG. 5) connected to and forming part of the frame of apparatus 10. The assembly 12' upon the opposite side of bridge structure 14 is substantially the same as assembly 12, and corresponding components are identified by the same reference numerals with the addition of a prime designation. The upper surfaces of belts 30, 30' and of bridge 14 lie in the same horizontal plane. A fluid-jet receiving slot 40 extends between opposite ends of bridge 14 at a right angle to the central longitudinal axis of apparatus 10. The sections of bridge 14 on opposite sides of slot 40 have a multiplicity of perforations extending therethrough, and are underlaid by manifolds 42 (FIG. 5) connected to a suitable source (not shown) of compressed air. During operation of apparatus 10 compressed air is discharged upwardly through the aforesaid perforations as indicated by the vertical arrows in FIG. 5, and provides vertical support of the "air-bearing" type for the portion of a glass sheet G overlying bridge 14.

During operation of apparatus 10 cutting fluid and therein-entrained particulate discharged by nozzle 18 passes material downwardly into and through slot 40 of bridge 14 after penetrating the sheet being cut. The fluid and particulate material is then received within the underlying tank 20 connected to or, as shown, integral with the bridge. Although not shown in the drawings, tank 20 customarily contains suitable structure and/or material for dissipating the kinetic energy of the fluid and other material received therein, and is provided with suitable outlets (not shown) permitting removal from the tank, on a continuous or periodic basis, of the fluid and other material received therein through bridge slot 40.

Fluid-discharging nozzle 18 and the therewith associated mounting and drive means, which are to be now described, are best shown in FIGS. 1, 3–7, and 16–18 of the drawings. The upper end of nozzle 18 receives pressurized fluid and entrained particulate material from a suitable source (not shown). The nozzle is mounted above and in vertical alignment with bridge slot 40 for bi-directional controlled movement from one end thereof to the other. The nozzle mounting means includes a bracket 46 that is slidably moveable along a pair of support rods 48 fixedly mounted above the sheet supporting means of apparatus 10 by horizontally and vertically extending beam-like frame members 50, 52, respectively. Suitable bearings also carried by the aforesaid frame members mount an elongate ball screw 54 for bi-directional rotative movement about its central axis under the impetus of a reversible drive motor 56 secured to one of the vertically extending frame members 52 and drivably connected to screw 54. Screw 54 extends through bracket 46 and through a bearing 58 and drive nut 60 (FIG. 18) fixedly connected to the bracket. Rotation of screw 54 therefore imparts controlled movement to bracket 46 along screw 54 and support rods 48. Suitable monitoring means (not shown) such as a rotary encoder operatively connected to screw 54 or the drive shaft of its drive motor 56, produces signals that are received by apparatus controller 26 (FIG. 1) and allow the same to continuously or at any desired time determine the precise position of the nozzle 18 carried by bracket 46. Proximity-type limit switches 62 (FIGS. 6, 18) are also provided adjacent opposite ends of the path of travel of bracket 46 for transmitting a "stop" signal to controller 25 and/or motor 56 if, due to a malfunction, bracket 46 should tend to overtravel. An elongate bellows-type enclosure 64 is connected to and extends outwardly from opposite sides of bracket 46. The enclosure 64 shields rods 48 and screw 54 from exposure to fluid and entrained grit or similar particulate matter that might rebound upwardly, particularly during initial phases of the cutting operation and as is indicated in FIG. 3 of the drawings, from the glass sheet G onto which nozzle 18 directs the fluid jet.

If the lower portion of nozzle 18 were of the same exterior diameter as its upper portion, a significant quantity of the particulate matter rebounding upwardly from glass G would engage the lower end surface of the nozzle and be deflected downwardly thereby into engagement with surface portions of the sheet on opposite sides of the intended cutting location. This could and normally would result in undesirable pitting or other marring of the surface of the glass. To eliminate or at least reduce this undesirable effect, the lower free end portion of nozzle 18 is of tapered shape and terminates at an end surface having an external diameter much less than that of the remainder of the nozzle.

To better accommodate glass sheets of varying thickness, nozzle 18 is connected to main bracket 46 by an auxiliary bracket 66 that is vertically moveable. The vertical position of bracket 66, and therefore of nozzle 18, may be varied by rotation of a wheel 68 connected to a screw 70 (FIGS. 17, 18) extending through a threaded vertical bore within bracket 66. Nozzle 18 and bracket 66 are releasably retained in a desired adjustive vertical position by spring-biased clamping means 72 best shown in FIG. 18.

The optional sheet positioning and supporting means 22 of apparatus 10 is best shown in FIGS. 1, 6, 7 and 13–15 of the drawings, to which reference is now particularly made. The aforesaid means includes a bank of horizontally extending spaced rollers 74 that are mounted by opposite side frame members of apparatus 10 and suitable bearings (not shown) for rotation about their central axes. The roller bank extends to the adjacent end of sheet-supporting belt assembly 12', and its upper surface is coplanar with that of the upper flight of belt 30'. A sheet positioning assembly 76 is mounted adjacent the right (as viewed in FIGS. 7 and 13) side of the bank of rollers 74, for adjustive movement parallel to the rollers, by downwardly extending support sections 78 that are slidably moveable longitudinally of support rods 80 fixedly secured to the frame of apparatus 10 beneath rollers 74. Support sections 78 carry releasable clamps 79 by which they may be secured at desired locations upon rods 80. A bar-like main section 82 of assembly 76, which has a laterally and vertically extending fixed stop element 84 at one end thereof, is fixedly connected to the upper ends of support sections 78 for movement therewith at an elevation above rollers 74. Bar 82 is parallel with the longitudinal axis of apparatus 10, and stop 84 is perpendicular to such axis. A plurality of pusher devices 86, 86', 94 are slidably mounted upon bar 82 for adjustive movement longitudinally thereof. The devices may be releasably locked in desired positions longitudinally of bar 82 by means of clamps 88, 88', 96 respectively associated therewith. Devices 86, 86', 94 respectively include actuators 90, 90', 100 of the pneumatic piston and cylinder type. Pusher elements 86, 86' upon the rod components of actuators 90, 90' engage the adjacent longitudinal edge of the glass sheet G upon rollers 74, at spaced locations along the length of such edge. A pusher element 98 of the end-most device 94 is pivotally connected to the body of such device and also to the rod of its actuator 100. Pusher 98 normally occupies the position illustrated by solid lines in FIG. 15, wherein it and actuator 100 are retracted. Upon extension of actuator 100, pusher 98 pivots to its extended position shown by phantom lines in FIG. 15 and solid lines in FIG. 13. During such movement pusher 98 engages the forward edge of glass sheet G, and displaces the sheet rearwardly until its rear edge abuts stop 84 of positioning assembly 76. This establishes the desired longitudinal position of sheet G. Establishment of the desired lateral position of the glass sheet is realized by extension of actuators 90, 90' of devices 86, 86'. This causes pusher elements 92, 92' to displace glass sheet G laterally until its distal longitudinal edge engages components of assemblies 16, 16' of the sheet moving means of apparatus 10.

The foregoing and other components of the sheet moving means of apparatus 10 are shown in FIGS. 1, 4, and 6–13. Referring particularly now to FIG. 1, a pair of support rods 102 and a ball screw 104 extend in parallel relationship to each other along the entire length of apparatus 10 on that side thereof distal from sheet positioning assembly 76. Each of the foregoing rod and screw components is fixedly and nonrotatively affixed to the frame of the apparatus. Sheet gripping assemblies 16, 16' are mounted in longitudinally spaced relationship to each other upon rods 102 for sliding movement therealong. Assemblies 16, 16' are interconnected for movement in unison with each other by a rod 106 extending therebetween and releasably connected to the respective assemblies by releasable clamping means 108, 108'. Adjustment of the spacing between assembly 16, 16' may be achieved by releasing either one of the clamps, effecting relative movement in the desired direction between the assemblies, and then resecuring the clamp. Such an adjustment is normally required and made only when there is a significant change in the length of the glass plates to be cut by apparatus 10. Movement of assemblies 16, 16' longitudinally of rods 102 and stationary ball screw 104 is effected by drive means carried by assembly 16 and best shown in FIGS. 1 and 8 of the drawings. The aforesaid drive means includes a reversible drive motor 109 whose output shaft is connected by a timing belt 110 to a ball nut 112 mounted by bearings 113 for rotative movement about ball screw 104 and for movement longitudinally thereof in response to such rotary movement. The aforesaid driving arrangement is preferred over one in which rotation is imparted to the ball screw rather than to the ball nut since a driven ball screw of the considerable length of the screw 104 could undergo "whip" motion detrimental to the precise operation of the drive means.

Movement of assembly 16 imparts movement at desired times to belts 30, 30' and rollers 74 of apparatus 10, through driving connections to be now described. A rigid bar 114 (FIGS. 1 and 13) interconnects driven assembly 16 and an endless chain 118 entrained about end sprockets 119, 120 and tensioning sprockets S. Sprocket 120 is fixedly mounted upon a shaft 124 connected by a clutch 126 to drive roll 32 of sheet supporting assembly 12. Sprocket 118 is affixed to a shaft 125 drivably connected to drive roll 32' of sheet supporting assembly 12'. On the opposite side of apparatus 10 an extension of shaft 125 is connected by a clutch 127 to a sprocket 128. A chain 130 is entrained about sprocket 128, about a tensioning sprocket 132, and about a plurality of driven sprockets 134 affixed to respective ones of the rollers 74 of the sheet receiving and positioning means of apparatus 10. As a result of the driving connections therebetween, movement of assembly 16 longitudinally of apparatus 10 produces corresponding movement of sheet supporting belt 30' and, when the respective clutches 126, 127 are engaged, corresponding movement of belt 30 and of rollers 74. Due to the difficulty if not impossibility of eliminating all lost motion and the like from the chain and friction drives of load supporting assemblies 12, 12', and from the chain drive of roller 74, the linear speeds of belts 30, 30' and surface speeds of roller 74 may not always be identical, and may differ somewhat from the linear speed of assemblies 16, 16'. However, the speed difference (if any) will in any event not diminish the precision of the cutting operation, which is dependent in significant part upon the precision of the longitudinal movement imparted to the sheet as it is being cut, since such movement of the sheet is positively controlled at all times during the cutting operation by the assemblies 16, 16'.

More specifically in the foregoing regard, each assembly 16, 16' has sheet gripping means that positively grips the adjacent longitudinal edge portion of each sheet G introduced into apparatus 10, and that thus constrains the sheet for movement in strict unison with the assemblies. Since the gripping means of the two assemblies is identical, only that associated with assembly 16 and shown in FIGS. 8≧12 of the drawings will be described. The sheet gripping means of assembly 16 includes two pairs of cooperating upper clamping jaws 136, 136' and lower clamping jaws 138, 138' that are spaced from and aligned with each other in the longitudinal direction of apparatus 10. Lower jaws 138, 138' are mounted upon the inner ends of opposite side sections 140, 140' of a bracket 142. Intermediate their lengths, jaws 138, 138' have shoulders defining alignment or "stop" surfaces 144, 144' thereon. Upper clamping jaws 136, 136' are carried upon the inner ends of side sections 146, 146' of a bracket 148 which overlies and "straddles" bracket 142. The adjacent side sections 136, 146 and 136', 146' of the two brackets are pivotally interconnected by pairs of parallel links 150, 150'. The side sections of brackets 142, 148 are also pivotally connected by pins 151, 151', that also extend through uppermost ones of the links 150, 150', to the inner ends of support arms 152. Arms 152 are in turn pivotally connected by a pin 154 to an upstanding frame member 156 of assembly 16. Counterweights 158 attached to the outer end portions of arms 152 balance the weight of the components connected to the forward portions of the arms, such that brackets 142, 148 and the clamping jaws thereon "float" about the axis of pin 154 and will remain in whatever position they occupy until positively displaced therefrom. Irrespective of their vertical position, the upper and lower jaws of each pair are maintained parallel to each by links 150, 150'.

Figure 9:
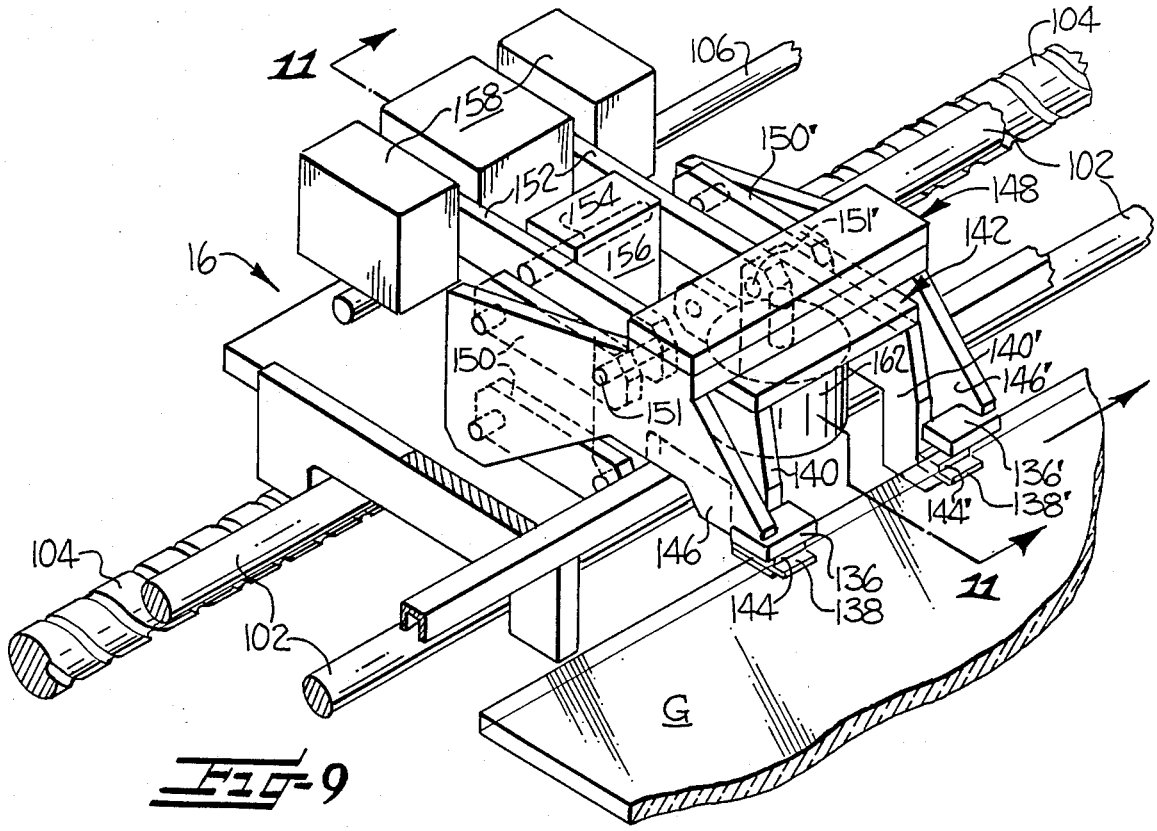
FIG. 9 is an enlarged fragmentary perspective view of interior components of the sheet-moving assembly and some other components shown in FIG. 8, a fragmentary portion of a glass sheet also being shown.
Figure 10:
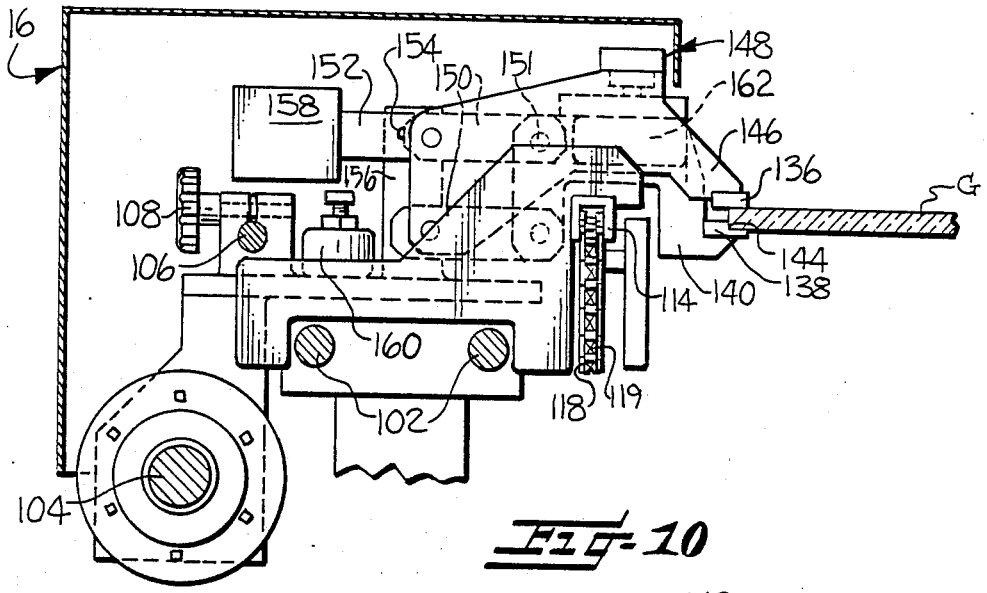
FIG. 10 is view primarily in side elevation of the sheet moving assembly and some other components shown in FIG. 9.
Figure 11:
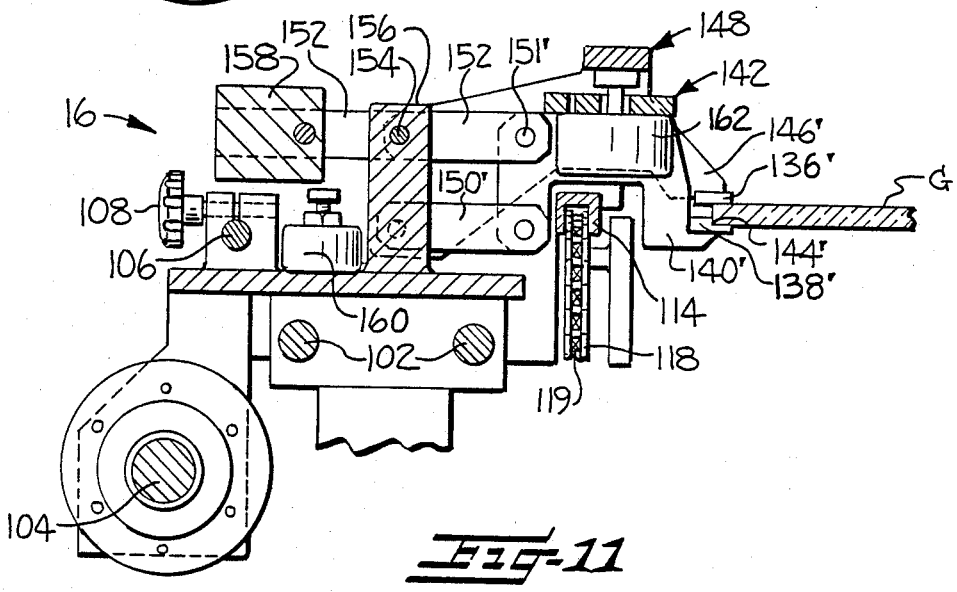
FIG. 11 is a view partially in elevation and partially in vertical section taken approximately along the line 11—11 through components shown in FIG. 9.
Figure 12:
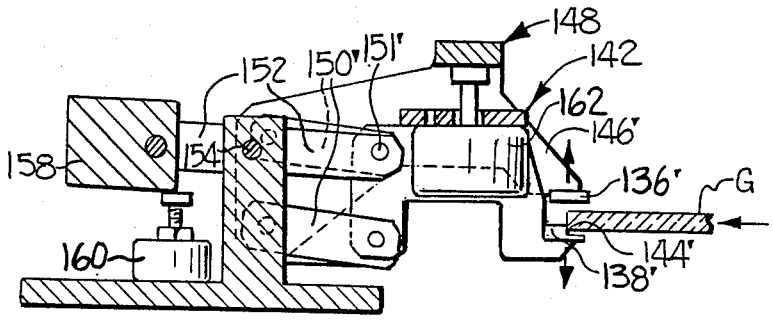
FIG. 12 is a view similar to FIG. 11 showing certain components in a different operating position.
Figures 13, 14, 15:
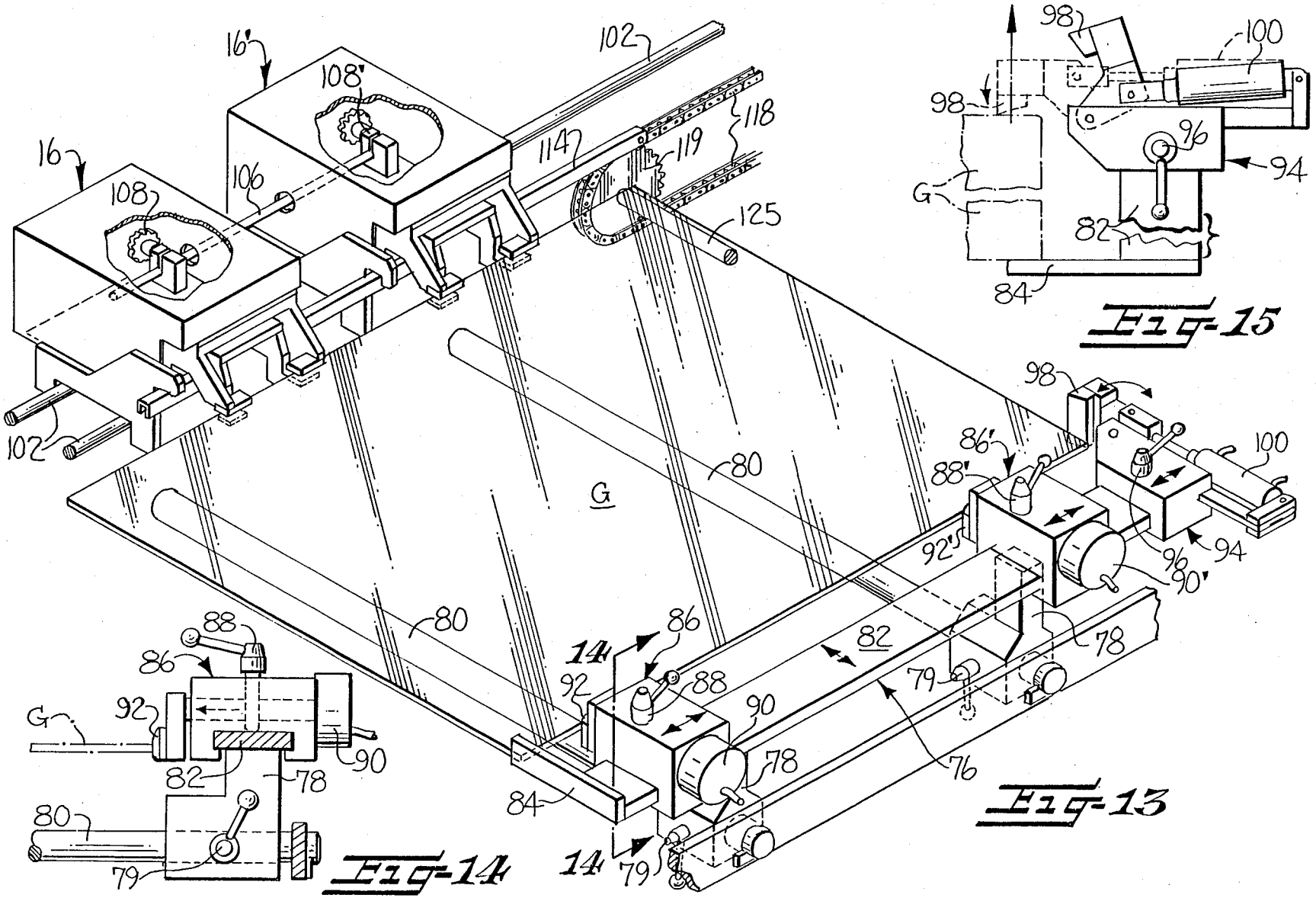
FIG. 13 is an enlarged fragmentary perspective view of components of the sheet moving means and the sheet receiving means of the apparatus.
FIG. 14 a view primarily in elevation and looking in the direction of the arrows 14—14 of FIG. 13 of a sheet positioning assembly, some adjacent components also being fragmentarily shown.
FIG. 15 is an enlarged top plan view of a sheet positioning device of the sheet positioning assembly of FIG. 13.
Figure 16:
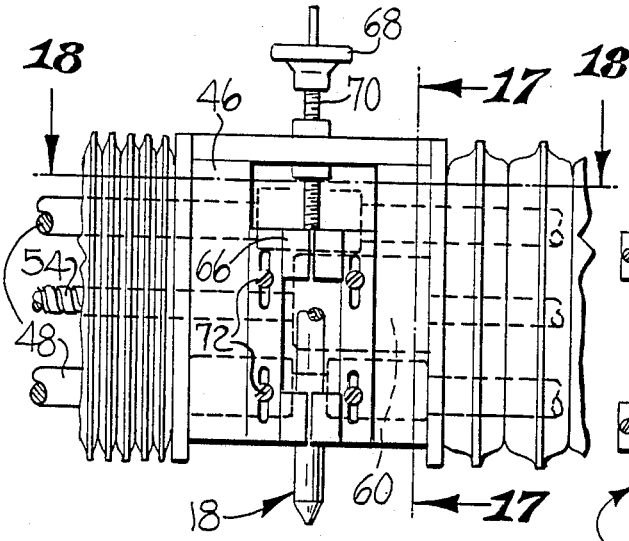
FIG. 16 is a rear elevational view of the fluid discharging nozzle of the apparatus, and of adjacent components for mounting and positioning the same.
Figure 17:
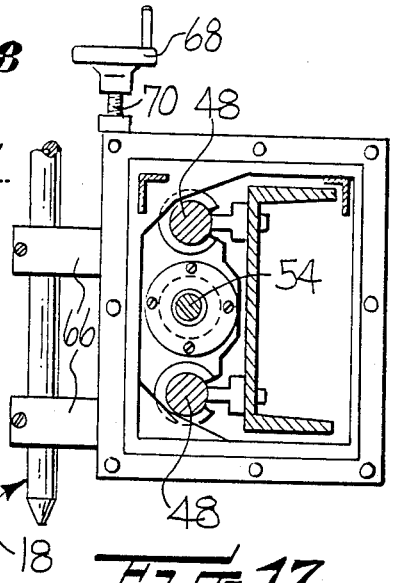
FIG. 17 is a side elevational view of the nozzle, and of adjacent components some of which are shown in vertical section taken along the line 17—17 of FIG. 16.
Figure 18:
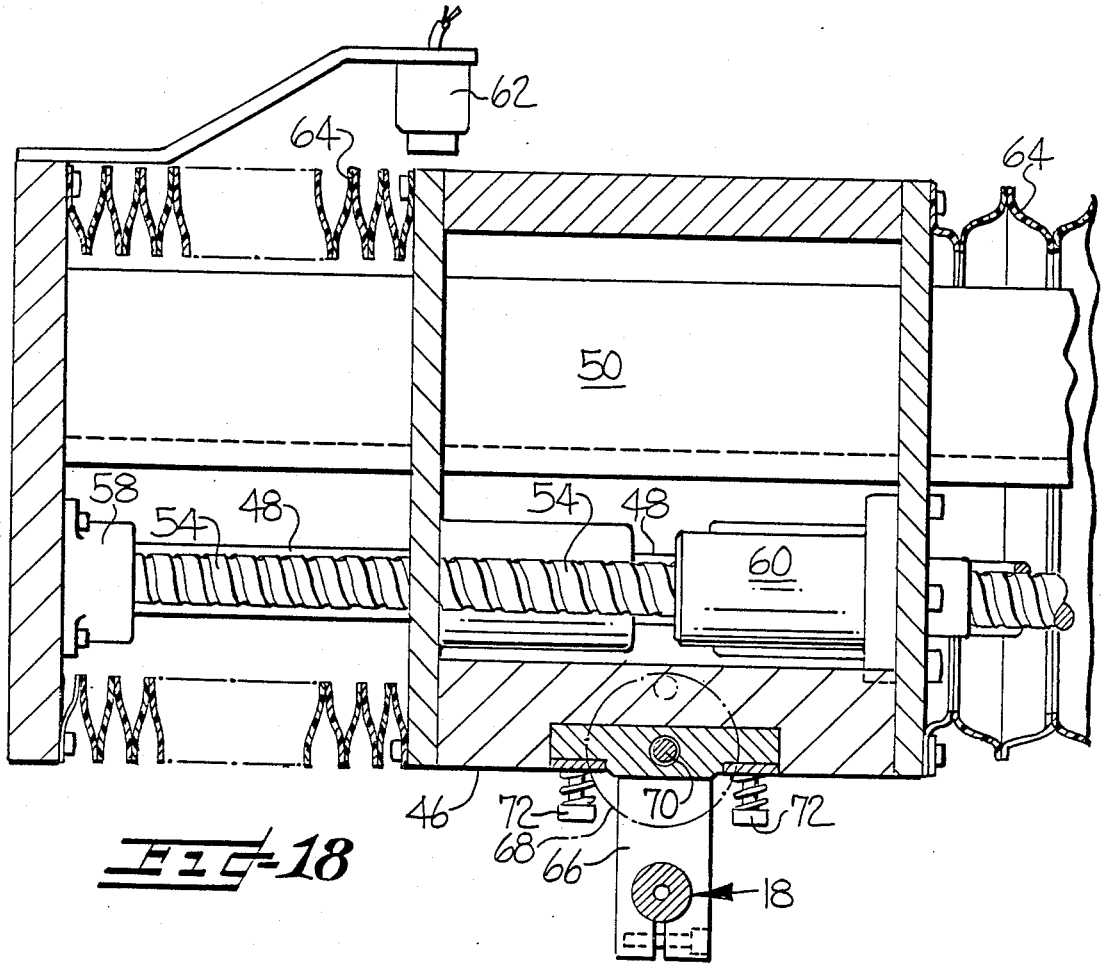
FIG. 18 is an enlarged fragmentary top plan view, partially in section taken along the line 18—18 of FIG. 16, of means for supporting and positioning the nozzle of the apparatus.

Assembly 16 further includes a pair of actuators 160, 162 of the pneumatic piston-and-cylinder type. The cylinder of actuator 160 (FIGS. 10–12) is fixedly mounted upon the frame of assembly 16 at a location beneath one of the counterweights 158. Extension of actuator 160 effects clockwise (as viewed in FIGS. 10–12) pivotal movement of the counterweights, and thus lowers the clamping jaws of the assembly to the positions thereof illustrated in FIG. 12. In such position the horizontal plane of the lower surface of a glass sheet G resting upon rollers 74 (FIG. 1) is slightly above the horizontal upper surfaces of lower jaws 138, 138', and is penetrated by the vertical stop surfaces 144, 144' of such jaws. The other actuator 162 of assembly 16 has its cylinder component connected to a top section of lower jaw bracket 142, and its rod component connected to a top section of upper jaw bracket 148. Extension of actuator 162 moves upper clamping jaws 136, 136' and lower clamping jaws 138, 138' away from each other to the fully-open position thereof shown in FIG. 12. Retraction of the actuator causes movement of the aforesaid jaws toward each other and into gripping engagement with the upper and lower surfaces of the edge portion of any glass sheet G then disposed therebetween, as is indicated in FIGS. 9 and 10. Due to the "floating" mounting of the clamping jaws, their closure does not subject sheet to any unbalanced vertical forces which, if present, might result in breakage of or other damage to the sheet.

The operation of apparatus 10 will now be briefly described. A glass sheet G, such as that shown in FIG. 6, is placed upon rollers 74 of the receiving section of tee apparatus. Unless already in properly adjusted positions, the lateral position of assembly 76 and the longitudinal positions of pushers 92, 92' and 98 are adjusted to accommodate the particular lateral and longitudinal dimensions of the sheet G. Assemblies 16, 16' are returned to their "starting" positions illustrated in FIG. 6, and their jaws are moved to their lowermost and fully open positions, unless the foregoing has been previously accomplished. Pusher 98 of positioning assembly 76 is actuated to move sheet G against positioning assembly stop 84, and to thus precisely establish the position of sheet G longitudinally of apparatus 10. Pusher 98 is retracted, and pushers 92, 92' are actuated to displace sheet G laterally until its distal edge portion is received between the open clamping jaws of assembly 16, 16' and is in engagement with the alignment or stop surfaces upon the lower ones of such clamping jaws. The clamping jaws of assembly 16, 16' then close upon and firmly grip the aforesaid edge portion of sheet G. Longitudinal movement of assemblies 16, 16' moves sheet G longitudinally from rollers 74 and onto sheet supporting assemblies 12, 12' and bridge 14. Rollers 74 are driven through clutch 127 (FIG. 1) during the foregoing movement until sheet G passes entirely therefrom. Clutch 127 in the roller drive train is then disengaged. This enables another sheet of glass to be loaded onto rollers 74 at any convenient time during operation of apparatus 10. Belts 30, 30' of assemblies 12, 12' continue to be driven in substantial unison with and by the assemblies 16, 16' while sheet G is cut by the fluid jet discharged from nozzle 18. During the cutting operation computer controller 26 coordinates the longitudinal-axis movements of assemblies 16, 16', and thus of sheet G, with the transverse-axis movements of nozzle 18 to cause cuts of any desired shape to be made in and from sheet G. The accuracy and precision of the cutting operation is greatly enhanced by the positive nature of the longitudinal movement imparted to the sheet G by assemblies 16, 16'. The precision of such movement is not dependent upon such factors as drive-chain "play", slippage between a load-supporting belt and its drive roller, slippage between a load-supporting belt and the load supported thereon, etc.

Once the cutting of the glass sheet G has been completed and the same has been advanced by assemblies 16, 16' into its final position upon assembly 12, movement of assembly 16, 16', and therefore of the belts of assemblies 12, 12', is halted and the clamping jaws of the assemblies are opened and moved to their lowered positions. The clutch 126 (FIG. 1) associated with the drive of assembly 12 is deactuated so that during the ensuing return movement of assemblies 16, 16' to their original starting position, the cut glass sheet G remains upon belt 30 of assembly 12. As soon as assembly 16, 16' reaches the starting position, a new sheet of glass is moved by the pushers of the positioning assembly 76 into the clamping jaws of the assemblies 16, 16', and a new cycle of operation identical to that previously described is commenced. Clutch 126 is again actuated when assembly 16, 16' initiates movement of the new glass sheet from rollers 74 and onto supporting assembly 12'. This therefore results in displacement of the previously cut sheet of glass upon assembly 12 longitudinally from the free outer end of such assembly.

Bellows-type enclosures 64' similar to the previously described enclosures 64 preferably are also provided in association with the mounting and drive means for assemblies 16, 16'.

In view of the fact that the glass sheets are displaced longitudinally of the apparatus 10 by assembly 16, 16', rather than by the underlying support means, it might be possible in some utilizations of apparatus 10 to replace belt-type support assemblies 12, 12' with air-bearing support means similar to that associated with bridge 14 of apparatus 10. However, when the sheets to be cut are of considerable size, the cost of generating an air bearing of correspondingly large size may be prohibitive.

While a preferred embodiment of the invention has been specifically shown and described, it will be appreciated that this was for purposes of illustration only, and not for purposes of limitation, the scope of the invention being in accordance with the following claims.

We claim:

1. Apparatus for cutting a sheet of substantially rigid material by means of a high velocity fluid jet, comprising:

supporting means for supporting said sheet during cutting thereof;

nozzle means for discharging said fluid jet against said supported sheet;

mounting means mounting said nozzle means for movement relative to said sheet along a first one of two orthogonal axes;

said supporting means including sheet-supporting belt means movable parallel to the second one of said axes;

sheet moving means separate from said supporting means for moving said sheet parallel to said second one of said axes, and for imparting generally synchronous movement to said belt means.

2. Apparatus as in claim 1, wherein said sheet moving means includes at least one sheet gripping assembly, means mounting said assembly for precisely controllable movement parallel to said second axis, and drive means for imparting said movement to said gripping assembly.

3. Apparatus as in claim 2, wherein said gripping assembly includes clamping means engageable with an edge portion of said sheet, and means mounting said clamping means for floating movement parallel to a third axis orthogonal to said first and second axes.

4. Apparatus as in claim 3, wherein said drive means includes a ball screw extending parallel to said second axis, a ball nut mounted for rotation about and movement longitudinally of said screw; and motor means connected to said ball screw for imparting said rotation to said ball nut, said motor means being movable with said ball nut longitudinally of said screw.

5. Apparatus as in claim 2, wherein said sheet moving means further includes a second gripping assembly also mounted by said assembly mounting means for movement parallel to said second axis, and adjustable interconnecting means for adjusting the positions of said gripping assemblies relative to each other and for interconnecting said assemblies for movement in unison with each other.

6. Apparatus as in claim 5, wherein each of said gripping assemblies includes a first pair of cooperating clamping jaws, and a second pair of cooperating clamping jaws, said clamping jaw pairs being spaced from each other in the direction of said second axis.

7. Apparatus as in claim 6, wherein each of said gripping assemblies further includes actuator means for effecting substantially simultaneous movement of said cooperating jaws of each of said pairs toward each other, and for effecting substantially simultaneous movement of said cooperating jaws of each of said pairs away from each other.

8. Apparatus as in claim 6, wherein each of said gripping assemblies further includes means mounting each of said pairs of said cooperating clamping jaws for floating movement generally parallel to a third axis orthogonal to said first and second axes.

9. Apparatus as in claim 8, wherein each of said gripping assemblies further includes actuator means for at desired times displacing said cooperating jaws of each of said pairs in unison with each other in a direction parallel to said third axis.

10. Apparatus as in claim 2, wherein said fluid jet discharged by said nozzle means contains solid particulate material such as garnet grit, and wherein said nozzle is of tapered shape and has a reduced diameter adjacent the end thereof from which said fluid jet and solid particle material are discharged.

11. Apparatus as in claim 1, wherein said sheet supporting means includes a stationary sheet supporting member, and air-bearing creating means for creating an air bearing between said sheet and said member.

12. Apparatus as in claim 11, wherein said supporting member has a perforate wall, and said air-bearing creating means includes a compressed-air manifold underlying said wall.

13. Apparatus as in claim 12, wherein said perforate wall of said supporting member has a slot therein extending generally parallel to said first axis for receiving fluid discharged from said nozzle means following passage thereof through said sheet.

14. Apparatus as in claim 13, wherein said belt means includes endless belt assemblies disposed closely adjacent and on opposite sides of said stationary support means and each having a belt flight substantially coplanar with said perforate wall of said stationary support means.

15. Apparatus as in claim 14, and further including support drive means connected to and driven by said sheet moving drive means for moving said belt flights generally in unison with each other and with said sheet moving means.

16. Apparatus as in claim 15, wherein said support drive means includes engageable and disengageable clutch means, said clutch means when disengaged causing one of said belt flights to remain stationary while said other of said belt flights undergoes movement.

17. Apparatus as in claim 15, and further including sheet receiving and positioning means for receiving and positioning a sheet prior to reception thereof by said supporting means, said sheet receiving and positioning means including an adjustable positioning assembly having stop means for accurately aligning said sheet relative to one of said axes.

18. Apparatus as in claim 17, wherein said positioning assembly includes pusher means for effecting engagement between said stop means and a sheet adjacent thereto.

19. Apparatus as in claim 18, wherein said sheet positioning assembly includes additional pusher means for displacing a thereto adjacent sheet into engagement with said sheet moving means.

20. Apparatus as in claim 19, wherein said sheet moving means includes at least one clamping jaw having a stop surface thereon engageable with a sheet displaced thereto by said additional pusher means.

21. Apparatus for cutting a sheet of substantially rigid material by means of a high velocity fluid jet, comprising:

supporting means for supporting said sheet during cutting thereof;

nozzle means for discharging said fluid jet against said supported sheet;

mounting means mounting said nozzle means for movement relative to said sheet along a first one of two orthogonal axes;

sheet moving means independent of said supporting means for moving said sheet parallel to the second one of said axes;

said sheet moving means including first and second sheet gripping assemblies, means mounting said assemblies for precisely controllable movement parallel to said second axis, drive means for imparting said movement to said gripping assemblies, and adjustable interconnecting means for adjusting the positions of said gripping assemblies relative to each other and for interconnecting said assemblies for movement in unison with each other.

22. Apparatus as in claim 21, wherein each of said gripping assemblies includes a first pair of cooperating clamping jaws, said clamping jaw pairs being spaced from each other in the direction of said second axis.

23. Apparatus as in claim 22, wherein each of said gripping assemblies further includes actuator means for effecting substantially simultaneous movement of said cooperating jaws of each of said pairs toward each other, and for effecting substantially simultaneous movement of said cooperating jaws of each of said pairs away from each other.

24. Apparatus as in claim 22, wherein each of said gripping assemblies further includes means mounting each of said pairs of said cooperating clamping jaws for floating movement generally parallel to a third axis orthogonal to said first and second axes.

25. Apparatus as in claim 24, wherein each of said gripping assemblies further includes actuator means for at desired times displacing said cooperating jaws of each of said pairs in unison with each other in a direction parallel to said third axis.

26. Apparatus for cutting a sheet of substantially rigid material by means of a high velocity fluid jet, comprising:

supporting means for supporting said sheet during cutting thereof;

nozzle means for discharging said fluid jet against said supported sheet;

mounting means mounting said nozzle means for movement relative to said sheet along a first one of two orthogonal axes;

sheet moving means independent of said supporting means for moving said sheet parallel to the second one of said axes;

said sheet supporting means including a stationary sheet supporting member, air-bearing creating means for creating an air bearing between said sheet and said member, said supporting member having a perforate wall having a slot therein extending generally parallel to said first axis for receiving fluid discharged from said nozzle means following passage thereof through said sheet, and said air-bearing creating means including a compressed-air manifold underlying said wall.

27. Apparatus as in claim 26, wherein said supporting means further includes endless belt assemblies disposed closely adjacent and on opposite sides of said stationary support means and each having a belt flight substantially coplanar with said perforate wall of said stationary support means.

28. Apparatus as in claim 27, and further including support drive means connected to and driven by said sheet moving drive means for moving said belt flights generally in unison with each other and with said sheet moving means.

29. Apparatus as in claim 28, wherein said support drive means includes engageable and disengageable clutch means, said clutch means when disengaged causing one of said belt flights to remain stationary while said other of said belt flights undergoes movement.

30. Apparatus as in claim 28, and further including sheet receiving and positioning means for receiving and positioning a sheet prior to reception thereof by said supporting means, said sheet receiving and positioning means including an adjustable positioning assembly having stop means for accurately aligning said sheet relative to one of said axes.

31. Apparatus as in claim 30, wherein said positioning assembly includes pusher means for effecting engagement between said stop means and a sheet adjacent thereto.

32. Apparatus as in claim 31, wherein said sheet positioning assembly includes additional pusher means for displacing a thereto adjacent sheet into engagement with said sheet moving means.

33. Apparatus as in claim 32, wherein said sheet moving means includes at least one clamping jaw having a stop surface thereon engageable with a sheet displaced thereto by said additional pusher means.

* * * * *